US007713497B2

(12) United States Patent
Mak

(10) Patent No.: US 7,713,497 B2
(45) Date of Patent: May 11, 2010

(54) LOW PRESSURE NGL PLANT CONFIGURATIONS

(75) Inventor: John Mak, Santa Ana, CA (US)

(73) Assignee: Fluor Technologies Corporation, Aliso Viejo, CA (US)

( * ) Notice: Subject to any disclaimer, the term of this patent is extended or adjusted under 35 U.S.C. 154(b) by 925 days.

(21) Appl. No.: 10/528,435

(22) PCT Filed: Aug. 15, 2002

(86) PCT No.: PCT/US02/26278

§ 371 (c)(1),
(2), (4) Date: Jun. 6, 2005

(87) PCT Pub. No.: WO2004/017002

PCT Pub. Date: Feb. 26, 2004

(65) Prior Publication Data

US 2005/0255012 A1 Nov. 17, 2005

(51) Int. Cl.

| | |
|---|---|
| ***B01J 8/00*** | (2006.01) |
| *B01J 10/00* | (2006.01) |
| *B01J 8/02* | (2006.01) |
| *F23J 1/00* | (2006.01) |
| *F23J 3/00* | (2006.01) |

(52) U.S. Cl. ..... 422/187; 422/211; 62/611; 62/612; 62/613; 62/617; 62/619; 62/620; 62/621; 62/622; 62/623; 62/625; 62/632; 62/634; 62/636

(58) Field of Classification Search ..... 422/187, 422/211; 62/636, 625, 611–613, 617–623, 62/634

See application file for complete search history.

(56) References Cited

U.S. PATENT DOCUMENTS 4,061,481 A * 12/1977 Campbell et al. ..... 62/621
4,617,039 A * 10/1986 Buck ..... 62/621
5,275,005 A 1/1994 Campbell et al. ..... 62/24
5,566,554 A * 10/1996 Vijayaraghavan et al. ..... 62/621
5,568,737 A * 10/1996 Campbell et al. ..... 62/621
5,771,712 A * 6/1998 Campbell et al. ..... 62/621
6,182,469 B1 * 2/2001 Campbell et al. ..... 62/621

(Continued)

FOREIGN PATENT DOCUMENTS

| | | |
|---|---|---|
| AU | 732141 | 4/2001 |
| WO | WO 98/47839 | * 10/1998 |
| WO | WO 03/095913 A1 | 11/2003 |

OTHER PUBLICATIONS

R. N. Pittman et al. "New Generation Processes for NGL/LPG Recovery" Proceeding of the Seventy-Seventh GPA Annual Convention.

*Primary Examiner*—Walter D Griffin
*Assistant Examiner*—Natasha Young
(74) *Attorney, Agent, or Firm*—Fish & Associates, PC

(57) ABSTRACT

A natural gas liquid plant includes a separator (103) that receives a cooled low pressure feed gas (4), wherein the separator (103) is coupled to an absorber (108) and a demethanizer (110). Refrigeration duty of the absorber (108) and demethanizer (110) are provided at least in part by expansion of a liquid portion of the cooled low pressure feed gas (4) and an expansion of a liquid absorber bottom product (19), wherein ethane recovery is at least 85 mol % and propane recovery is at least 99 mol %. Contemplated configurations are especially advantageous as upgrades to existing plants with low pressure feed gas where high ethane recovery is desirable.

19 Claims, 5 Drawing Sheets

U.S. PATENT DOCUMENTS 6,244,070 B1 * 6/2001 Lee et al. ..... 62/620
6,354,105 B1 * 3/2002 Lee et al. ..... 62/619
6,363,744 B2 * 4/2002 Finn et al. ..... 62/621
6,401,486 B1 * 6/2002 Lee et al. ..... 62/630
2001/0052241 A1 * 12/2001 Jain et al. ..... 62/621
2002/0065446 A1 5/2002 Wilkinson et al. ..... 585/802

* cited by examiner

- Prior Art -

- Prior Art -

LOW PRESSURE NGL PLANT CONFIGURATIONS

FIELD OF THE INVENTION

The field of the invention is natural gas liquids plants, and especially relates to natural gas liquids plants with high ethane recovery.

BACKGROUND OF THE INVENTION

As ethane recovery becomes increasingly economically attractive, various configurations have been developed to improve the recovery of ethane from natural gas liquids (NGL). Most commonly, numerous processes employ either cooling of feed gases via turbo expansion or a subcooled absorption process to enhance ethane and/or propane recovery.

For example, a typical configuration that employs turbo expansion cooling assisted by external propane and ethane refrigeration is shown in Prior Art FIG. 1. Here, the feed gas stream 1 is split into two streams (2 and 3) for chilling. Stream 3 is cooled by the demethanizer side reboiler system 111 to stream 24, while stream 2 is chilled by the cold residue gas from separator 106 and demethanizer 110 (via streams 13, 18, and 38). The two streams 2 and 3 are typically chilled to about −102° F., and about 15% of the feed gas volume is condensed. The liquid condensate volume is about 3800 GPM (at a typical feed gas flow rate of 2 BSCFD supplied at about 600 psig and 68° F. with a composition of typically 1% $N_2$, 0.9% $CO_2$, 92.35% $C_1$, 4.25% $C_2$, 0.95% $C_3$, 0.20% iC4, 0.25% $nC_4$ and 0.1% $C_5$+), which is fed to the upper section of the demethanizer 110 via lines 8 and 9 and JT valve 104. The vapor stream 7 is expanded via expander 105 and the resulting two-phase mixture from line 12 is separated in separator 106. Over 80% of the feed gas is flashed off as stream 13 in separator 106. Separated liquid 14 is pumped by pump 107 via line 15 to the demethanizer operating typically at 400 psia. The demethanizer produces a residue gas 18 that is partially depleted of ethane and an NGL product 23 containing the ethane plus components. Side reboilers 111 are used for stripping the methane component from the NGL (via lines 25-30) while providing a source of cooling for the feed gas 3. The demethanizer overhead vapor stream 18 typically at −129° F. combines with the flash gas stream 13 from separator 106 and fed to the feed exchanger 101 for feed gas cooling (Additional cooling is provided via external ethane and propane refrigerants via lines 44 and 45).

Unfortunately, such a process is typically limited to 60% ethane recovery and 94% propane recovery. Further reduction in demethanizer pressure produces marginal improvement in recoveries, which is normally not justified due to the higher cost of the residue compression. Moreover, at such conditions, the demethanizer will operate close to the $CO_2$ freezing temperature.

Another known configuration for ethane recovery is a gas subcooled process as shown in Prior Art FIG. 2, which typically employs two columns, an absorber and a demethanizer and a rectifier exchanger to improve the NGL recovery. In a typical design, the feed gas is cooled in feed exchanger 101 to −85° F. with refrigeration supplied by residue gas 38, side reboilers stream 25 and stream 27, propane refrigeration 44 and ethane refrigeration 45. About 5% of the feed gas is separated in separator 103, producing 1100 GPM liquid (with feed gas parameters similar or substantially identical as described above) which is further letdown in pressure and fed to lower section of absorber 108. Vapor stream 7 from the separator is split into two streams that are individually fed to the rectifier exchanger and the expander. About 66% of the total flow is expanded via expander 105 and fed to the middle section of absorber 108 and the remaining 34% is cooled in a rectifier exchanger 109 to −117° F. by the absorber overhead vapor. The exit liquid from exchanger 109 is letdown in pressure to 390 psia while being cooled to −137° F. and routed to the top of the absorber as reflux. The absorber generates a residue gas at −138° and a bottom intermediate product at −118° F. that is pumped by pump 112 and fed to the top of demethanizer 110. The demethanizer produces an overhead gas 22 that is routed to the bottom Of the absorber and an NGL product stream 23 containing the ethane plus components. Side reboilers are used for stripping the methane component from the NGL while providing a source of cooling for the feed gas. The absorber overhead vapor stream 18 typically at −138° F. is used for feed cooling in the rectifier exchanger 108 and feed exchanger 101.

However, such configurations are frequently limited to 72% ethane recovery and 94% propane recovery. Similar to the previous known configurations of Prior Art FIG. 1, further reduction in demethanizer pressure produces marginal benefit in recoveries, which is normally not justified due to the higher residue compression requirement.

Thus, although various configurations and methods for relatively high ethane recovery from natural gas liquids are known in the art, all or almost all of them suffer from one or more disadvantages. Therefore, there is still a need for improved configurations and methods for high ethane recovery, and especially where the feed gas has a relatively low pressure.

SUMMARY OF THE INVENTION

The present invention is directed to natural gas liquid (NGL) plants in which refrigeration duty of an absorber and a demethanizer are provided at least in part by expansion of a liquid portion of a cooled low pressure feed gas and further expansion of a portion of a vapor portion of a cooled low pressure feed gas via turboexpansion.

In one aspect of the inventive subject matter, a natural gas liquid plant has a separator that receives a cooled low pressure feed gas and is fluidly coupled to an absorber and a demethanizer, wherein refrigeration duty of the absorber and demethanizer are provided at least in part by expansion of a liquid portion of the cooled low pressure feed gas, further turboexpansion of a vapor portion of the cooled low pressure feed gas, ethane and propane refrigeration, and heat recovery exchange with residue gas and column side reboilers.

It is contemplated that the cooled low pressure feed gas in such contemplated plants has been cooled by a cooler that employs an expanded liquid portion of the cooled low pressure feed gas as a refrigerant. Furthermore, it is preferred that the absorber produces an absorber bottom product that is pumped and fed to the demethanizer as cold lean reflux. In yet other aspects of such configurations, the separator separates a vapor portion from the cooled low pressure feed gas, and a first part of the vapor portion is further cooled and introduced into the absorber, while a second part of the vapor portion is expanded and cooled in a turboexpander.

In another aspect of the inventive subject matter, a natural gas liquid plant may include a separator that separates a cooled low pressure feed gas into a liquid portion and a vapor portion, wherein the liquid portion is reduced in pressure in a first pressure reduction device, thereby providing refrigeration for a first cooler that cools a low pressure feed gas to form the cooled low pressure feed gas, wherein at least part of the vapor portion is cooled in a second cooler and reduced in pressure in a second pressure reduction device before entering an absorber as lean absorber reflux, and wherein the absorber produces an absorber overhead product that provides refrigeration for the second cooler, and wherein the absorber produces an absorber bottoms product that is fed into a demethanizer as a lean demethanizer reflux.

Especially contemplated low pressure feed gas has a pressure of about 400 psig to about 700 psig, and a portion of the low pressure feed may be cooled in a plurality of side reboilers that are thermally coupled to the demethanizer. In preferred configurations, the first pressure reduction device may comprise a hydraulic turbine, and the second pressure reduction device may comprise a Joule-Thomson valve.

In yet other aspects, it is contemplated that the liquid portion that is reduced in pressure is fed into the demethanizer, and/or part of the vapor portion is expanded in a turboexpander and fed into a second separator that produces a liquid that is employed as a lean demethanizer reflux and a vapor that is fed into the absorber.

In a further aspect of the inventive subject matter, a natural gas liquid plant may include a primary and secondary cooler that cool a low pressure feed gas, and a separator that separates the cooled low pressure feed gas in a liquid portion and a vapor portion. In such configurations, a first pressure reduction device reduces pressure of the liquid portion, thereby providing refrigeration for the secondary cooler, a third cooler cools at least part of the vapor portion, wherein the cooled vapor portion is expanded in a pressure reduction device, and an absorber receives the cooled and expanded vapor portion and produces an overhead product that provides refrigeration for the third cooler and a bottom product that is employed as a reflux in a demethanizer.

It is especially contemplated that ethane recovery in contemplated configurations is at least 85 mol % and propane recovery is at least 99 mol %, and it is further contemplated that the first and second coolers and the absorber may be installed as an upgrade to an existing plant.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
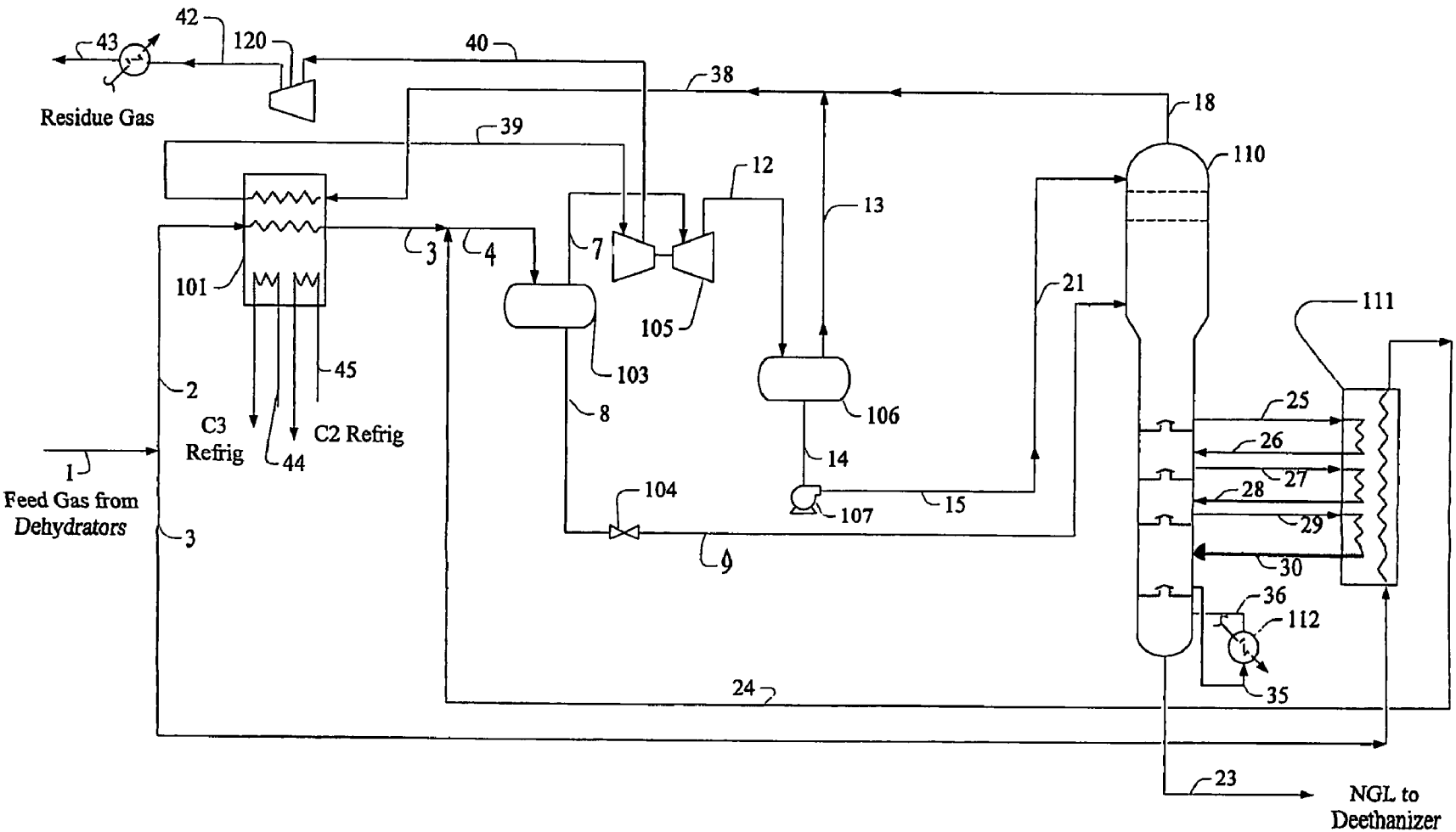
FIG. 1 is a prior art schematic of a known NGL plant configuration using propane and ethane refrigeration and a turboexpander.
Figure 2:
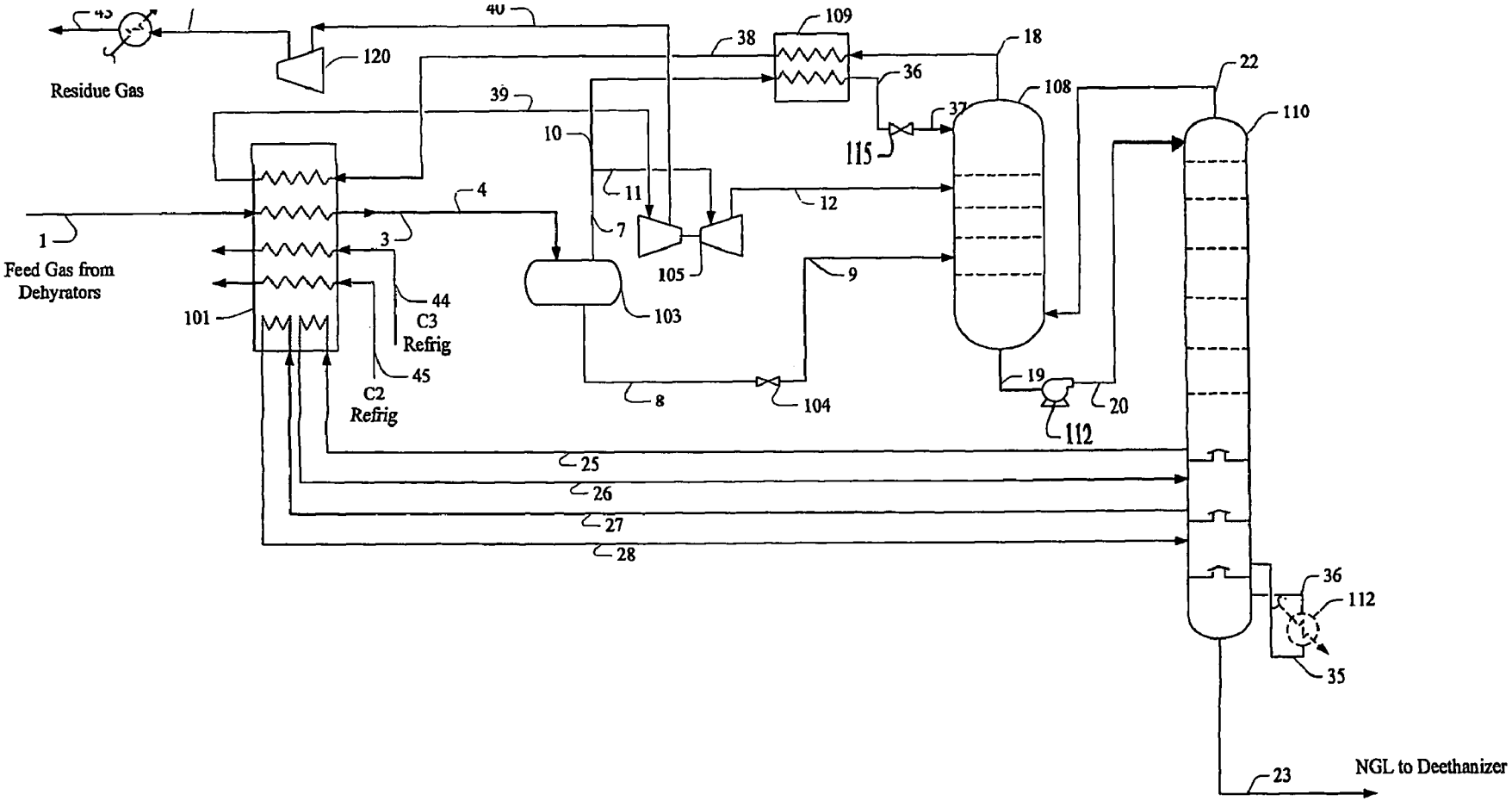
FIG. 2 is a prior art schematic of a known NGL plant configuration using a subcooled process including an absorber and a demethanizer.

Currently known NGL recovery configurations typically require a relatively high feed gas pressure or feed gas compression where the feed gas pressure is relatively low (especially where high ethane and propane recovery is desired) to generate sufficient cooling that is at least in part provided by a turbo expander.

Viewed from another perspective, when known NGL plants are operated with relatively low feed gas pressure without pre-compression, the refrigeration produced by turbo-expansion is limited due to the low expansion ratio across the expander. Where cooling via turbo expander is not sufficient, additional cooling can be supplied by external propane and/or ethane refrigeration. However, even if ethane refrigeration is employed, the coolant temperature is typically limited to −85° F., which typically limits the ethane recovery level. Consequently, in a typical low feed pressure operation of known NGL plants, the ethane recovery is frequently limited to about 60 mol % to 72 mol %.

The inventor now surprisingly discovered that high ethane and propane recoveries can be achieved at low feed gas pressure in configurations in which refrigeration is internally generated from expansion of the liquids with the use of one or more hydraulic turbines and additional heat exchangers. The term "low pressure feed gas" as used herein refers to a pressure that is at or below about 1100 psig, and more typically between about 400 psig and 700 psig, and even less. As also used herein, the term "about" when used in conjunction with numeric values refers to an absolute deviation of less than or equal to 10% of the numeric value, unless otherwise stated. Therefore, for example, the term "about 10 mol %" includes a range from 9 mol % (inclusive) to 11 mol % (inclusive).

As still further used herein, and with respect to a demethanizer or absorber, the terms "upper" and "lower" should be understood as relative to each other. For example, withdrawal or addition of a stream from an "upper" portion of a demethanizer or absorber means that the withdrawal or addition is at a higher position (relative to the ground when the demethanizer or absorber is in operation) than a stream withdrawn from a "lower" region thereof. Viewed from another perspective, the term "upper" may thus refer to the upper half of a demethanizer or absorber, whereas the term "lower" may refer to the lower half of a demethanizer or absorber. Similarly, where the term "middle" is used, it is to be understood that a "middle" portion of the demethanizer or absorber is intermediate to an "upper" portion and a "lower" portion. However, where "upper", "middle", and "lower" are used to refer to a demethanizer or absorber, it should not be understood that such column is strictly divided into thirds by these terms.

In particularly preferred configurations, a heat exchanger provides a portion of the feed gas cooling duty and condenses a majority of the ethane components prior to turbo-expansion. As a result, the separated vapor used for the rectifier condenser in the demethanizer is a lean gas consisting of over 95% methane. Thus, by using a lean reflux on the demethanizer overhead, high ethane recovery can be realized even at a low feed pressure.

Figure 3:
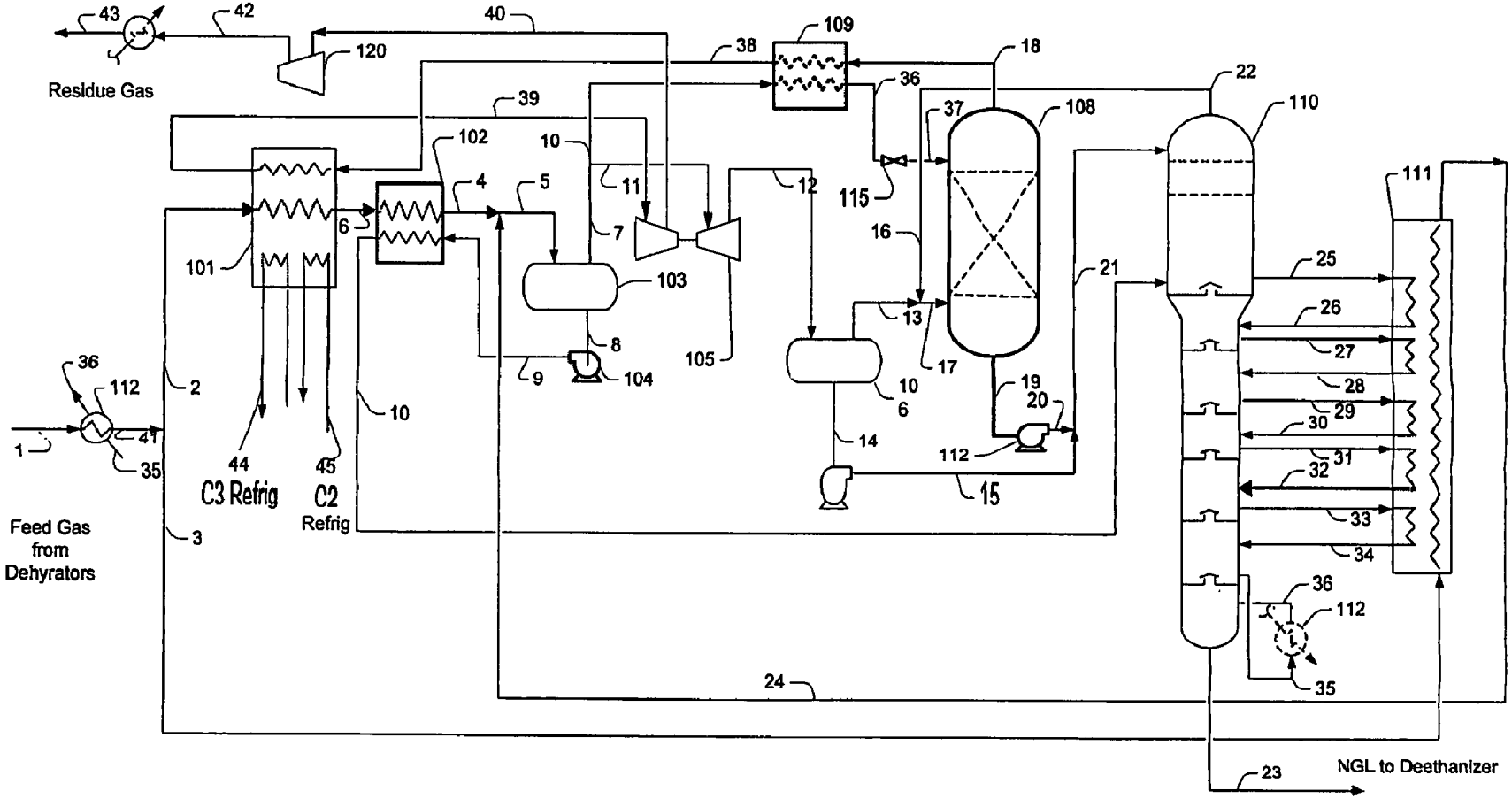
FIG. 3 is schematic of an NGL plant configuration according to the inventive subject matter.

In one especially contemplated aspect of the inventive subject matter and as depicted in FIG. 3, a feed gas stream 1 (at a flow rate of 2 BSCFD supplied at about 600 psig and 68° F.; Composition is typically 1% $N_2$, 0.9% $CO_2$, 92.35% $C_1$, 4.25% $C_2$, 0.95% $C_3$, 0.20% $iC_4$, 0.25% $nC_4$ and 0.1% $C_{5+}$) is cooled in the feed gas cooler 112 (by stream 35) to stream 41 to 54° F. with the refrigeration supplied by the reboiler duty in the demethanizer 110. Stream 41 is split into two streams 2 and 3 for further cooling. About 14% is split to stream 3 which is cooled by the demethanizer side reboiler system 111 to −102° F. The remaining portion constituting stream 2 is chilled in cooler 101 to stream 6 at −75° F. by the stream 38 (outlet from rectifier exchanger 109), propane refrigeration 44 and ethane refrigeration 45. In order to achieve particularly effective low feed chilling temperature, a close approach reboiler system 111 (typically comprising five side reboilers with streams 25-34) are required.

A secondary exchanger 102 further refrigerates stream 6 to stream 4 to −108° F. with refrigeration supplied by stream 9 after being expanded via hydraulic turbine 104. Stream 4 is combined with stream 24 from the side reboilers of the side reboiler system 111 to form stream 5 at −108° F. At this point, about 25% of the feed gas volume is condensed and about 25% of the methane and 85% of the ethane plus components is condensed in the liquid phase. A separator 103 separates a liquid condensate from a vapor. The liquid condensate (stream 8) volume is about 6600 GPM, which is letdown in pressure in hydraulic turbine 104 generating shaft horsepower while chilling the condensate from −108° F. to −133° F. The cold expanded liquid stream 9 is used to cool the feed gas in the secondary exchanger 102. The heated liquid from exchanger 102 (stream 10) is routed to the upper section of the demethanizer for stripping the methane components.

Separated vapor stream 7, a lean gas consisting of over 96% methane, is split into two streams. About 60% of the total flow (stream 11) is expanded via expander 105 to 345 psia, and the resulting two-phase mixture in line 12 is separated in separator 106. Liquid stream 14 from separator 106 is pumped to the top of the demethanizer 110 via stream 15, while vapor stream 13 from separator 106 is combined with the demethanizer overhead stream 22 to form stream 17 and fed to the bottom of absorber 109. The remaining 40% of the total flow (stream 10) is cooled in rectifier exchanger 109 to −122° F. by the absorber overhead vapor. The exit liquid stream 36 from exchanger 109 is letdown in pressure via JT valve 115 to 340 psia while being cooled to −140° F. and routed to the top of the absorber as reflux. The absorber generates a residue gas stream 18 at −150° and a bottom intermediate product stream 19 at 145° F. that is pumped by pump 112 and fed to the top of demethanizer 10 via lines 20 and 21. The demethanizer produces an overhead gas 22 that is routed to the bottom of the absorber and an NGL product stream 23 containing the ethane plus components. Side reboilers are used for stripping the methane component from the NGL while providing a source of cooling for the feed gas. The absorber overhead vapor stream 18 typically at −150° F. is used for feed cooling in the rectifier exchanger 109 and feed exchanger 101 (via streams 18, 28, and 39, before recompression in expander compressor 105 and residue gas compressor 120 and leaving the plant via lines 40, 42, and 43).

Such configurations have been calculated (data not shown) to improve ethane recovery from 72% to 94% and propane recovery from 94% to 99% as compared to a conventional gas subcooled process. While not wishing to be bound by any particular theory or hypothesis, it is contemplated that at least part of the large improvements in ethane and propane recoveries may be attributed to the deep chilling in the secondary exchanger 102 that separates most of the ethane components and provides a very lean gas (i.e., containing at least 95 mol % methane) for refluxing in the rectifier exchanger. A further contributing factor may be provided by the highly effective chilling system provided by multiple side reboilers from the demethanizer that can cool the feed gas to a very low temperature.

Figure 4:
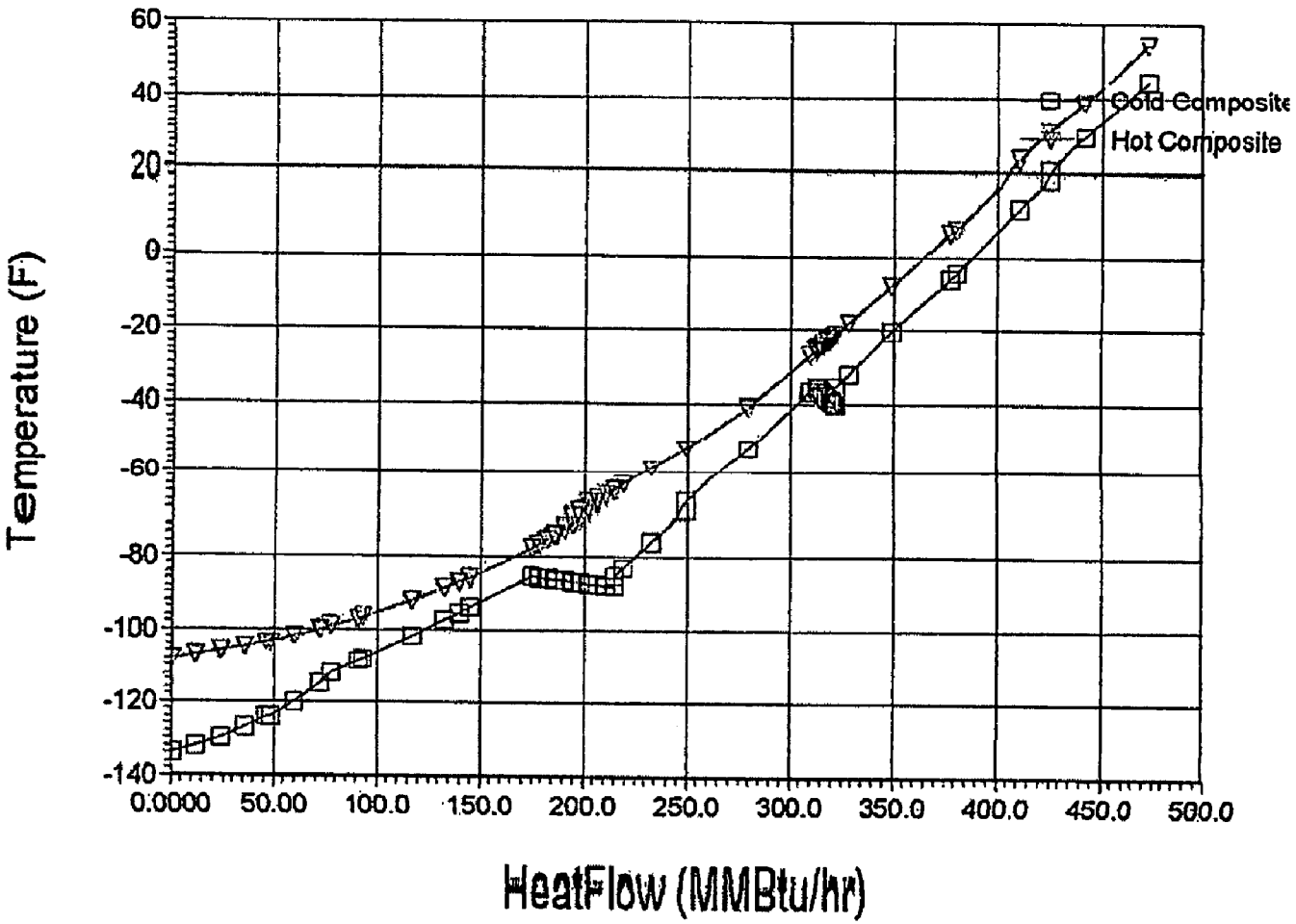
FIG. 4 is a heat composite curve for the feed exchangers 101 and 102 of FIG. 3.
Figure 5:
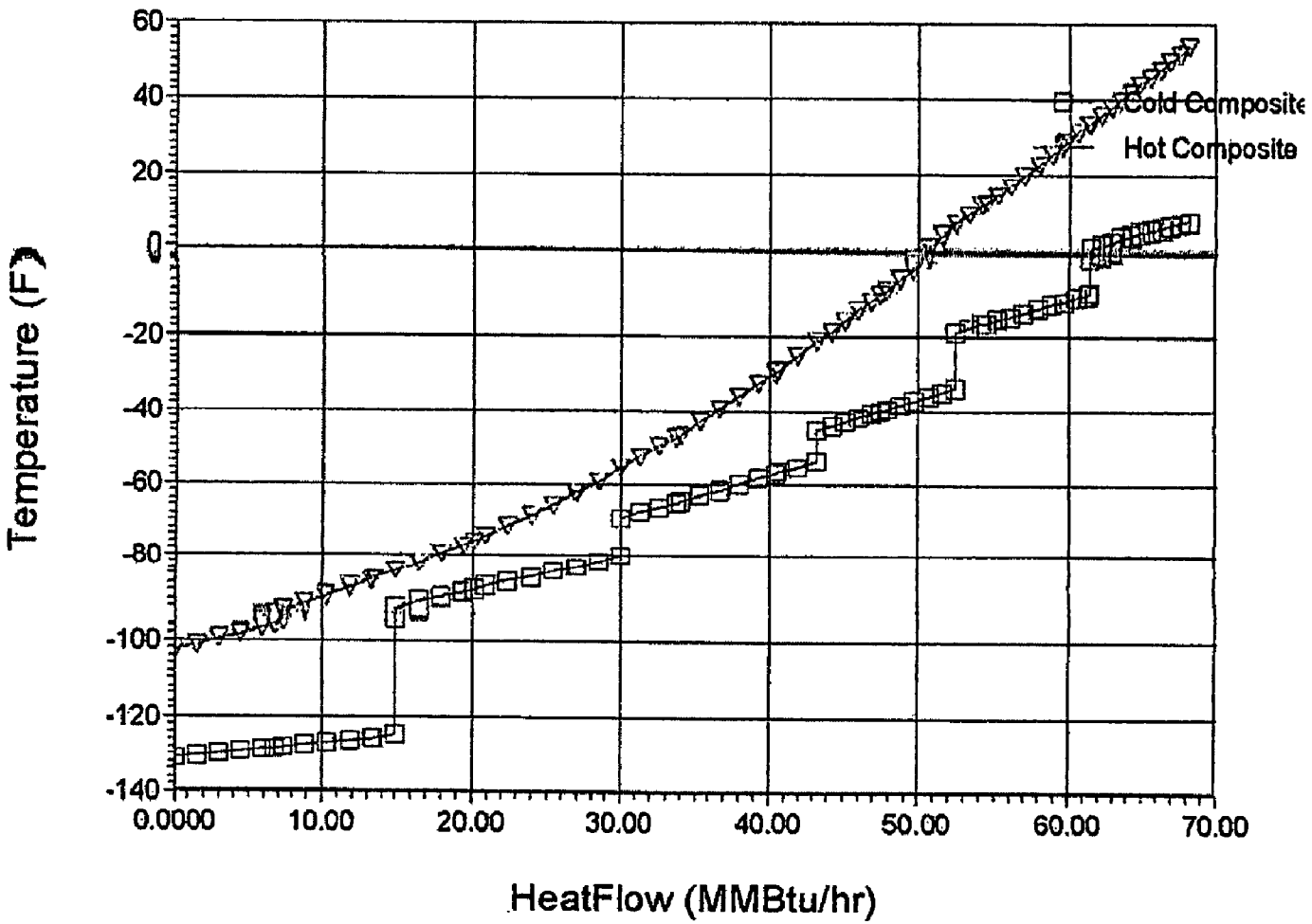
FIG. 5 is a heat composite curve for the side reboilers 111 of FIG. 3.

The heat composite curve for the feed exchanger (here exchangers 101 and 102) is shown in FIG. 4, and the heat composite curve for the side reboilers is shown in FIG. 5. As can be seen from these curves, close temperature approaches are designed into the system resulting in a highly efficient process.

With respect to the feed gas it should be recognized that configurations according to the inventive subject matter are not limited to a particular feed gas composition and pressure, and that the feed gas composition and pressure may vary substantially. However, it is generally contemplated that suitable feed gases particularly include natural gas liquids and especially those with a pressure between about 100 psig to about 1100 psig, more typically with a pressure between about 300 psig to about 1000 psig, and most typically with a pressure between about 400 psig to about 700 psig. Furthermore, it is generally preferred that the feed gas is at least partially dehydrated using molecular sieves and/or glycol dehydration.

Cooling of the feed gas is preferably achieved with the refrigeration duty supplied at least in part by the demethanizer reboiler, and further cooling is provided by the reboiler system for a first portion of the feed gas and by the feed gas coolers for a second portion of the feed gas. While the side reboilers typically cool between about 5-30% vol of the feed gas and the feed gas coolers typically cool between about 70-95% vol of the feed gas, it should be appreciated that the exact proportions may vary and will typically depend (among other parameters) on the composition of the feed gas, pressure of the feed gas and the temperature of the feed gas after a first cooling step. Of course it should be recognized that the first feed gas cooler (101) may receive internal or external ethane and/or propane refrigerant and/or still further receive refrigeration provided by the absorber overhead product (residue gas).

The secondary heat exchanger will provide cooling derived from the depressurization of the liquid portion of the cooled feed gas. Consequently, it should be recognized that the cooling duty will at least in part depend on the pressure differential across the first pressure reduction device. Thus, it is generally preferred that the pressure differential across the first pressure reduction device is at least between about 150 psig and about 400 psig, and more preferably between about 200 psig and about 300 psig. While it is generally contemplated that numerous pressure reduction devices may be employed for pressure reduction, it is typically preferred that the pressure reduction device comprises a hydraulic turbine, which may provide work (e.g., generate electricity) to recover at least some of the expansion energy. However, where appropriate, alternative pressure reduction devices may also be suitable and include JT valves or expansion vessels. Consequently, and particularly depending on the pressure differential and pressure reduction device, the temperature drop of the liquid portion is typically between about −14 degrees Fahrenheit and about −40 degrees Fahrenheit, and most typically between about −19 degrees Fahrenheit and about −29 degrees Fahrenheit.

It should be especially appreciated that in such configurations between about 15% vol and about 35% vol, and most typically about 25% vol, of the feed gas volume are condensed after the secondary feed gas cooler, wherein the liquid phase typically includes about 25% of the methane and about 85% of the ethane and heavier components. Thus, the vapor portion of the cooled feed gas will typically comprise at least 85%, more typically at least 90%, and most typically at least 96% methane, which may advantageously be employed as cool and lean reflux for the absorber. A typical composition of the lean reflux will generally include no more than about 13% ethane and higher components, more typically no more than about 8% ethane and higher components, and most typically no more than about 2% ethane and higher components In such configurations, it is especially preferred that at a first portion (typically between about 30% and 50%, and most typically about 40%) of the vapor portion from the separator is cooled in a rectifier exchanger and still further cooled via a second pressure reduction device before entering the absorber (The rectifier exchanger will provide cooling via the absorber overhead product). Similarly to the first pressure reduction device described above, the nature of the second pressure reduction device may vary. However, it is generally preferred that the second pressure reduction device is a JT valve or a turbine. It is further contemplated that a second portion 4 of the vapor portion from the separator is expanded in a turboexpander, wherein the expansion energy may advantageously be utilized for recompression of the residue gas. After expansion in the turbo expander, the partially condensed vapor portion is further separated in a separator and the lean vapor phase is fed to the absorber while the liquid phase is combined with the absorber bottoms product and fed to the top of the demethanizer.

Thus, it should be recognized that in such configurations the demethanizer can be operated at a relatively high pressure with substantially improved ethane recoveries, and it is contemplated that a typical demethanizer pressure is between about 250 psig and about 450 psig, and more typically between about 320 psig and about 400 psig. Moreover, due to the relatively high operating pressure of the demethanizer, potential problems associated with carbon dioxide freezing may be reduced, if not entirely avoided. In particularly preferred configurations, a closely integrated demethanizer side reboiler system will generally have at least three side reboilers as highly efficient heat and cooling system that is capable of cooling a portion of the feed gas to a very low temperature.

Consequently, a natural gas liquid plant may include a separator that separates a cooled low pressure feed gas into a liquid portion and a vapor portion, wherein the liquid portion is reduced in pressure in a first pressure reduction device, thereby providing refrigeration for a first cooler that cools a low pressure feed gas to form the coo led low pressure feed gas; wherein at least part of the vapor portion is cooled in a second cooler and reduced in pressure in a second pressure reduction device before entering an absorber as lean absorber reflux; and wherein the absorber produces an absorber overhead product that provides refrigeration for the second cooler, and wherein the absorber produces an absorber bottoms product that is fed into a demethanizer as lean demethanizer reflux.

In such configurations, it is especially preferred that the low pressure feed gas has a pressure of about 400 psig to about 700 psig, and that a portion of the low pressure feed is cooled in a plurality of side reboilers that are thermally coupled to the demethanizer. With respect to the first pressure reduction device it is generally contemplated that a hydraulic turbine reduces the pressure (and produces work), and that the second pressure reduction device comprises a Joule-Thomson valve to provide effective cooling. It should further be recognized that in such configurations the liquid portion that is reduced in pressure is fed into the demethanizer, and that at least part of the vapor portion is expanded in a turboexpander and fed into a second separator that produces a liquid that is employed as a lean demethanizer reflux and a vapor that is fed into the absorber.

Viewed from another perspective, contemplated natural gas liquid plants may include a primary and secondary cooler that cool a low pressure feed gas, and a separator that separates the cooled low pressure feed gas into a liquid portion and a vapor portion: In such configurations, a first pressure reduction device will reduce the pressure of the liquid portion, thereby providing refrigeration for the secondary cooler, and a third cooler cools at least part of the vapor portion, wherein the cooled vapor portion is expanded in a pressure reduction device. An absorber receives the cooled and expanded vapor portion and produces an overhead product that provides refrigeration for the third cooler and a bottom product that is fed to a demethanizer as lean reflux. As already discussed above, such configurations lend themselves particularly useful where the feed gas is a low pressure feed gas, typically at a pressure of less than about 1100 psig, and more typically at a pressure between about 400 psig and 700 psig. With respect to the pressure reduction devices, the plurality of side reboilers, and the turboexpander, the same considerations as discussed above apply. Furthermore, it should be appreciated that the primary cooler may employ external ethane and/or external propane as additional refrigerants, and similar to the configurations described above, the absorber overhead product may act as a refrigerant in a heat exchanger that cools lean absorber reflux.

Viewed from still another perspective, a natural gas liquid plant may comprise a separator that receives a cooled low pressure feed gas and that is fluidly coupled to an absorber and a demethanizer, wherein the refrigeration duty of the absorber and demethanizer is provided at least in part by expansion of a liquid portion of the cooled low pressure feed gas and an expansion of a vapor portion using a device other than a turboexpander (however, a turboexpander may also be included). In such configurations, it is especially preferred that the cooled low pressure feed gas has been cooled by a cooler that employs an expanded liquid portion of the cooled low pressure feed gas as refrigerant. Furthermore, it is generally preferred that the absorber produces an absorber bottom product that is fed into the demethanizer as lean reflux. The separator in such configurations separates a vapor portion from the cooled low pressure feed gas, wherein a first part of the vapor portion is cooled and introduced into the absorber, and/or wherein a second part of the vapor portion is expanded and cooled in a turboexpander.

Therefore, it should be recognized that the ethane recovery in contemplated systems and configurations will generally be greater than 85% when processing a low pressure feed gas, and that such systems and configurations are particularly suited for retrofitting into an existing plant to increase throughput and NGL recovery. It should be particularly appreciated that the increase in throughput and NGL recovery can be achieved without re-wheeling the expander since a portion of the feed gas is bypassed around the expander to a rectifier exchanger that is used to produce a liquid for refluxing the demethanizer. In this aspect, most equipment in an existing plant can be reused without substantial modifications and the inventor contemplates that the recovery improvement requires addition of a few pieces of equipment and in many cases, the increase in NGL recovery may pay off the installation cost in less than 3 years.

Thus, specific embodiments and applications of Low pressure NGL plant configurations have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A natural gas liquid plant, comprising:

a separator that is configured to allow separation of a cooled low pressure feed gas having a feed gas pressure of at or below 1100 psig into a liquid portion and a vapor portion, and a first pressure reduction device that is configured to receive the liquid portion and to allow reduction of pressure of the liquid portion to provide refrigeration for a first cooler that is fluidly coupled to the separator and that is configured to allow cooling of a low pressure feed gas to thereby allow formation of the cooled low pressure feed gas;

a second cooler and a second pressure reduction device fluidly coupled to the separator, wherein the second cooler is configured to allow cooling of at least part of the vapor portion, and wherein the second pressure reduction device is configured to reduce pressure of the part of the vapor portion to a degree effective to provide the part of the vapor portion to an absorber as lean absorber reflux; and wherein the absorber is configured to produce an absorber overhead product to thereby provide refrigeration for the second cooler, and wherein the absorber is further configured to produce an absorber bottoms product, and a demethanizer fluidly coupled to the absorber and configured to receive the absorber bottoms product as lean reflux.

2. The natural gas liquid plant of claim 1 wherein the low pressure feed gas has a pressure of about 300 psig to about 700 psig.

3. The natural gas liquid plant of claim 1 further comprising a plurality of side reboilers that are thermally coupled to the demethanizer and that are configured to cool a portion of the low pressure feed gas.

4. The natural gas liquid plant of claim 1 wherein the first pressure reduction device comprises a hydraulic turbine, and wherein the second pressure reduction device comprises a Joule-Thomson valve.

5. The natural gas liquid plant of claim 1 wherein the demethanizer is configured to receive the liquid portion that is reduced in pressure as a demethanizer feed stream.

6. The natural gas liquid plant of claim 1 further comprising a turboexpander that is configured to allow expansion of part of the vapor portion, and further comprising a second separator that is configured to receive the expanded part of the vapor portion and to produce a liquid that is employed as a lean demethanizer reflux and a vapor that is fed into the absorber.

7. The natural gas liquid plant of claim 1 wherein ethane recovery is at least 85 mol % and propane recovery is at least 99 mol %.

8. A natural gas liquid plant, comprising:

a primary and secondary cooler that are configured to cool a low pressure feed gas having a feed gas pressure of at or below 1100 psig, and a separator that is configured to separate the cooled low pressure feed gas at about feed gas pressure in a liquid portion and a vapor portion;

a first pressure reduction device that is configured to reduce pressure of the liquid portion to thereby provide refrigeration for the secondary cooler;

a third cooler that is configured to cool at least part of the vapor portion, and a pressure reduction device that is configured to expand the cooled vapor portion to form a lean absorber reflux; and an absorber that is configured to receive the lean absorber reflux and to produce an overhead product that provides refrigeration for the third cooler and a bottom product that is employed as reflux in a demethanizer.

9. The natural gas liquid plant of claim 8 wherein the low pressure feed gas is at least partially dehydrated and has a pressure of between about 300 psig and about 700 psig.

10. The natural gas liquid plant of claim 8 wherein the first pressure reduction device comprises a hydraulic turbine and wherein the second pressure reduction device comprises a Joule-Thomson valve.

11. The natural gas liquid plant of claim 8 further comprising a plurality of side reboilers that are thermally coupled to the demethanizer and that are configured to cool a portion of the low pressure feed gas.

12. The natural gas liquid plant of claim 8 further comprising a turboexpander that is configured to expand part of the vapor portion and a second separator that is fluidly coupled to the turboexpander and that is configured to produce a liquid that is employed as a lean demethanizer reflux and a vapor that is fed into the absorber.

13. The natural gas liquid plant of claim 8 wherein the primary cooler is configured to employ as least one of external ethane, external propane, and the absorber overhead product as a refrigerant.

14. The natural gas liquid plant of claim 8 wherein ethane recovery is at least 85 mol % and propane recovery is at least 99 mol %.

15. A natural gas liquid plant that comprises a separator that is configured to receive a cooled low pressure feed gas having a feed gas pressure of at or below 1100 psig and that is fluidly coupled to an absorber and a demethanizer, wherein the plant is further configured such that refrigeration duty of the absorber and demethanizer are provided at least in part by expansion of a liquid portion of the cooled low pressure feed gas from the feed gas pressure and an expansion of a vapor portion from the feed gas pressure using a device other than a turboexpander, and wherein the demethanizer is configured to receive the expanded liquid portion as demethanizer feed.

16. The natural gas liquid plant of claim 15 further comprising a cooler that is configured to further cool the cooled low pressure feed gas using an expanded liquid portion of the cooled low pressure feed gas as a refrigerant.

17. The natural gas liquid plant of claim 15 wherein the absorber is configured to produce an absorber bottom product that is fed to the demethanizer as reflux.

18. The natural gas liquid plant of claim 15 wherein the separator is configured to separate a vapor portion from the cooled low pressure feed gas and wherein a Joule-Thomson valve is configured to further cool a first part of the vapor portion for introduction into the absorber.

19. The natural gas liquid plant of claim 18 further comprising a turboexpander that is configured to expand and cool a second part of the vapor portion.

* * * * *